US006258522B1

(12) United States Patent
Mariotti et al.

(10) Patent No.: US 6,258,522 B1
(45) Date of Patent: Jul. 10, 2001

(54) SILVER BROMOIODIDE CORE-SHELL GRAIN EMULSION

(75) Inventors: Mario Mariotti, Carcare; Stefania Ghirardo, Savona; Giuseppe Rocca, Carcare; Mauro Avidano, Asti; Alessandro Gunnella, Savona; Ezio Astengo, Bragno/Cairo Montenotte, all of (IT)

(73) Assignee: Ferrania S.p.A., Savona (IT)

( * ) Notice: Subject to any disclaimer, the term of this patent is extended or adjusted under 35 U.S.C. 154(b) by 0 days.

(21) Appl. No.: 09/576,530

(22) Filed: May 23, 2000

(30) Foreign Application Priority Data

May 25, 1999 (EP) ..... 99110138

(51) Int. Cl.[7] ..... G03C 1/005
(52) U.S. Cl. ..... 430/567; 430/569
(58) Field of Search ..... 430/567, 569

(56) References Cited

U.S. PATENT DOCUMENTS

| | | | | |
|---|---|---|---|---|
| 4,477,564 | | 10/1984 | Cellone et al. | 430/567 |
| 4,614,711 | | 9/1986 | Sugimoto et al. | 430/567 |
| 4,668,614 | * | 5/1987 | Takada et al. | 430/567 |
| 4,728,602 | | 3/1988 | Shibahara et al. | 430/567 |
| 5,780,216 | * | 7/1998 | Ihama | 430/567 |
| 5,906,914 | * | 5/1999 | Taguchi et al. | 430/567 |
| 5,955,253 | * | 9/1999 | Kawakami | 430/568 |
| 5,965,344 | * | 10/1999 | Ando et al. | 430/567 |
| 6,007,977 | * | 12/1999 | Nishikawa | 430/567 |

FOREIGN PATENT DOCUMENTS

| | | | |
|---|---|---|---|
| 202 784 | * | 4/1986 | (EP) . |
| 0202784 | | 9/1991 | (EP) . |
| 0299719 | | 1/1993 | (EP) . |

* cited by examiner

*Primary Examiner*—Janet Baxter
*Assistant Examiner*—Amanda C. Walke
(74) *Attorney, Agent, or Firm*—Mark A. Litman & Assoc.; Mark A. Litman

(57) ABSTRACT

The present invention relates to a light-sensitive emulsion, and a light-sensitive photographic material containing the same, comprising silver bromoiodide grains of a core shell structure comprising a) an inner core consisting essentially of silver bromide or silver bromoiodide, the silver iodide content of said inner core being within the range of 0 to 10 mole %, and b) a plurality of shells consisting essentially of silver bromide or silver bromoiodide, wherein a pure silver iodide phase representing from 0.1 to 5 mole % of the total silver halide grain content is interposed between two adjacent shells, and wherein at least one of said adjacent shells has a silver iodide content higher than 5 mole %.

12 Claims, No Drawings

SILVER BROMOIODIDE CORE-SHELL GRAIN EMULSION

FIELD OF THE INVENTION

The present invention relates to photographic silver halide core-shell emulsions. More particularly, the invention relates to a silver bromoiodide emulsion having grains comprising several phases with different iodide content, which emulsion shows better granularity and sensitometric properties.

BACKGROUND OF THE ART

There have been more strict requirements for silver halide emulsions for photographic use, which has increased the demands for the high level photographic characteristics such as, for example, high speed, excellent graininess, high sharpness, low fog, wider exposure latitude range and so on.

The above mentioned requirements have been satisfied by well-known silver bromoiodide grain emulsions having a high silver iodide content in the inner part of the grains and a specific core-shell structure in the grains thereof. It is well known in the photographic art that light absorbing increases in the order of silver chloride, silver bromide and silver iodide, but development activity correspondingly decreases in the same order. By using the above described core-shell silver bromoiodide emulsions, a good balance between light sensitivity and development activity has been obtained.

Examples of core-shell silver bromoiodide emulsion are described in many patent and literature references. For example, U.S. Pat. No. 4,668,614 and U.S. Pat. No. 4,728,602 describe a monodispersed core-shell silver bromoiodide emulsion having a core part comprising a silver iodide content of 10 to 45 mol % and a shell part comprising a silver iodide content lower than 5 mol %., with an average silver iodide content higher than 7 mol %. When examined by X-ray diffractometry, two peaks are evidentiated. The first one corresponding to the high iodide core part, the second one to the low iodide shell part. According to the claimed invention it is preferred to have a ratio between the diffraction intensity of the two peaks in the range of from 1/10 to 3/1, more preferably 1/3 to 3/1.

Similarly, European application EP 299,719 discloses a core-shell silver halide emulsion having a core comprising not less than 10 mol % of silver iodide, at least one shell consisting of silver bromide or silver bromoiodide, the outermost of which has a silver iodide content not higher than 5 mol %, and an average silver iodide content of not less than 10 mol %.

EP 309,119 discloses a core-shell silver halide emulsion having at least three silver bromide or silver bromoiodide phases of different composition. According to a preferred embodiment of the claimed emulsion, the innermost phase has a silver iodide content of at least 10 mol %, the outermost phase has a silver iodide content of not more than 6 mol %, and the intermediate phase has a silver iodide content difference with the outermost or innermost phase of at least 3 mol %. When examined by X-ray diffraction, the claimed emulsion shows three or more diffraction peaks, each corresponding to a phase containing a different percentage of iodide.

EP 202,784 describes a core-shell type silver halide emulsion having an inner core essentially consisting of silver bromide or silver bromoiodide and a plurality of shells. The outermost shell has a silver iodide content ranging from 0 to 10 mol %, the innermost shell has a silver iodide content at least 6 mol % higher than that of the outermost shell, and an intermediate shell has a silver iodide content is at least 3 mol % lower than that of the innermost shell and at least 3 mol % higher than that of the outermost shell.

U.S. Pat. No. 4,477,564 describes a multiphase bromoiodide emulsion having an average silver iodide content higher than 12%.

U.S. Pat. No. 4,614,711 describes silver bromoiodide grains with a core shell structure with a core of silver bromide or bromiodide and a first layer composed of silver bromoiodide, exterior to said core and containing more iodide than said core by 10 mol % or more.

U.S. Pat. No. 5,780,216 discloses a color negative silver halide photographic material with a core shell emulsion having a plurality of shells comprising an inner core consisting essentialy of silver bromide or bromoiodide and a plurality of shells of silver bromide or silver bromoiodide comprising a high iodide shell interposed between two shells consisting essentially of silver bromide.

SUMMARY OF THE INVENTION

The present invention relates to a light-sensitive emulsion comprising silver bromoiodide grains of a core shell structure comprising:

a) an inner core consisting essentially of silver bromide or silver bromoiodide, the silver iodide content of said inner core being within the range of 0 to 10 mole %, and b) a plurality of shells consisting essentially of silver bromide or silver bromoiodide, wherein a pure silver iodide phase representing from 0.1 to 5 mole % of the total silver halide grain content is interposed between two adjacent shells, and wherein at least one of said adjacent shells has a silver iodide content higher than 5 mole %.

DETAILED DESCRIPTION OF THE INVENTION

The light-sensitive emulsion of the present invention comprises silver bromoiodide grains having an inner core and a plurality of shells. The inner core consists essentially of silver bromide or silver bromoiodide. The plurality of shells consists essentially of silver bromide or silver bromoiodide having different compositions.

The silver iodide content of the inner core is in the range of from 0 to 20 mol % relative to the total silver halide content of the inner core phase, preferably from 0 to 10 mol %, and more preferably from 0 to 5 mol %. According to the most preferred aspect of the present invention the inner core consists essentially of silver bromide.

The silver iodide content of each shell is in the range of from 0 to 40 mol %, preferably from 0 to 20 mol % relative to the total silver halide content of the shell. The plurality of shells comprises at least two shells having different silver halide composition.

The minimal core-shell structure of the silver halide grains according to the present invention consists in an inner core and two shells surrounding the inner core. The number of shells surrounding the inner core preferably ranges from two to four. Accordingly, the core-shell structure of the silver halide grains according to the present invention consists in an inner core, an innermost shell adjacent the inner core, an outermost shell, and, optionally, one or more intermediate shells interposed between the innermost shell and the outermost shell. Preferably, the innermost shell adjacent to the inner core has a silver bromoiodide composition, with a silver iodide content of from 2 to 20 mol %, most preferably from 3 to 10 mol % relative to the total silver halide content of the shell, and the outermost shell has a silver bromide composition. The intermediate shells can have a silver bromide or silver bromoiodide composition, with a silver iodide content ranging from 0 to 40 mol %, preferably from 0 to 20 mol % relative to the total silver halide content of the shell.

The silver content of the core and the plurality of shells relative to the total silver content of the grain can have different values depending on the number of shells representing the plurality of shells. Preferably, the silver content of the inner core represents from 20 to 70 mol %, more preferably from 30 to 60 mol % relative to the total silver content of the grain. Preferably, the silver content of the plurality of shells represents from 30 to 80 mol %, more preferably from 40 to 70 mol % relative to the total silver content of the grain. Each shell can have a silver content ranging from 5 to 40 mol %, preferably from 10 to 25 mol % relative to the total silver content of the grain.

According to the essential aspect of the present invention, a pure silver iodide phase is interposed between two adjacent shells The pure silver iodide phase has a silver content of from 0.1 to 5 mol %, preferably from 1 to 3 mol % relative to the total silver content of the grain.

According to the second essential aspect of the present invention, at least one of the two adjacent shells surrounding the above mentioned pure silver iodide phase (that is, the two shells in contact with the pure silver iodide phase) has a silver iodide content higher than 5 mole %, preferably higher than 10 mole % relative to the total silver halide content of the shell.

The average iodide content of the silver halide emulsion grains according to the invention ranges from 1 to 15 mol %, preferably from 2 to 10 mol %, and more preferably from 3 to 6 mol % relative to the total halide content of the emulsion grains.

Accordingly, the core shell emulsion according to the present invention can be represented by the following, not limitative examples:

| |
|---|
| Core: AgBr |
| Shell: $AgBr_{85\%}I_{15\%}$<br>Pure iodide phase<br>Shell: AgBr |
| Core: AgBr |
| Shell: $AgBr_{95\%}I_{5\%}$<br>Shell: $AgBr_{85\%}I_{15\%}$<br>Pure iodide phase<br>Shell: $AgBr_{95\%}I_{5\%}$<br>Shell: AgBr |
| Core: AgBr |
| Shell: $AgBr_{95\%}I_{5\%}$<br>Shell: AgBr<br>Pure iodide phase<br>Shell: $AgBr_{85\%}I_{10\%}$ |
| Core: AgBr |
| Shell: $AgBr_{95\%}I_{4\%}$<br>Pure iodide phase<br>Shell: $AgBr_{85\%}I_{15\%}$ |

-continued

| |
|---|
| Core: AgBr |
| Shell: $AgBr_{95\%}I_{5\%}$<br>Shell: $AgBr_{80\%}I_{20\%}$<br>Pure iodide phase<br>Shell: AgBr |
| Core: AgBr |
| Shell: $AgBr_{95\%}I_{5\%}$<br>Shell: AgBr<br>Pure iodide phase<br>Shell: $AgBr_{85\%}I_{15\%}$<br>Shell: AgBr |

According to a more preferred aspect of the present invention the core shell grains have a structure comprising a silver bromide inner core, an innermost shell shell consisting essentially of silver bromoiodide with a silver iodide content of from more than 2 to 20 mole %, preferably from 3 to 17 mole %, a pure silver iodide phase representing from 0.1 to 5 mole % of the total silver halide grain content, and an outermost shell consisting essentially of silver bromide.

According to the most preferred aspect of the present invention the core shell grains have a structure comprising a silver bromide inner core, an innermost shell consisting essentially of silver bromoiodide with a silver iodide content within the range of from 2 to 20 mole %, an intermediate shell consisting essentially of silver bromide, a pure silver iodide phase representing from 0.1 to 5 mole % of the total silver halide grain content, another intermediate shell consisting essentially of silver bromoiodide with a silver iodide content of from more than 5 mole % to 20 mole %, and an outermost shell consisting essentially of silver bromide.

The wording "consisting essentially of silver bromide or silver bromoioide" widely employed hereinabove in describing the core-shell emulsion according to the present invention means that the amount of halides different than iodide and bromide is less than 3 mole %.

The light-sensitive emulsion of the present invention is preferably monodispersed, and the coefficient of variation of the distribution (COV) is preferably lower than 0.30, more preferably lower than 0.20, and most preferably lower than 0.15. The COV is a value obtained by dividing the distribution (standard deviation) of the grain size in terms diameter of a projected area of each grain, by the average grain size.

The silver iodobromide grains of the emulsion of the present invention may be regular grains having a regular crystal structure such as cube, octahedron, and tetradecahedron, or the spherical or irregular crystal structure, or those having crystal defects such as twin plane, or those having a tabular form, or the combination thereof.

The term "cubic grains" according to the present invention is intended to include substantially cubic grains, that is silver iodobromide grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver bromoiodide grains having average grain sizes in the range from 0.2 to 3 $\mu$m, more preferably from 0.4 to 1.5 $\mu$m. Preparation of silver halide emulsions comprising cubic silver iodobromide grains is described, for example, in Research Disclosure, Vol. 184, Item 18431, Vol.176, Item 17644 and Vol. 308, Item 308119.

Other iodobromide emulsions according to this invention are those which employ one or more light-sensitive tabular grain emulsions. The tabular silver bromoiodide grains contained in the emulsion of this invention have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver bromoiodide grains suitable for use in this invention range from about 0.3 μm to about 5 μm, preferably 0.5 μm to 3 μm, more preferably 0.8 μm to 1.5 μm. The tabular silver bromoiodide grains suitable for use in this invention have a thickness of less than 0.4 μm, preferably less than 0.3 μm and more preferably less than 0.2 μm.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter-:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter: thickness ratio of at least 2:1 and a thickness lower than 0.4 μm, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, December 1989, Item 308119 "Photographic Silver Halide Emulsions, Preparations, Addenda, Processing and Systems", and Research Disclosure, September 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, GB 1,302,405, U.S. Pat. No. 3,801,326, U.S. Pat. No. 4,046,376, U.S. Pat. No. 3,790,386, U.S. Pat. No. 3,897,935, U.S. Pat. No. 4,147,551, and U.S. Pat. No. 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing the silver halide emulsions of the present invention, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

The core-shell silver bromoiodide emulsion of the present invention can be prepared according to the following processing method. For sake of clarity, the following description was limited to the preparation of a core-shell emulsion comprising two shells, but the present invention is not intended to be limited to such a constructions.

1. An aqueous solution prepared by dissolving gelatin, a bromide salt, and, optionally a iodide salt in distilled water was provided in a reaction vessel. The solution was stirred by a dispersator and kept at about 30° to 60° C.

2. To the resulting solution, an aqueous silver salt solution and an aqueous bromide salt solution were added by double jet under stirring, by keeping constant the temperature at about 30° to 60° C. The double jet addition of silver and bromide salts can be repeated one or more times, by varying the addition conditions (pAg, rate of addition, etc.) until to reach the precipitation of the total silver requested for the formation of the core. The rate of addition kept constant in the range of from 5 to 60 ml/minute or can vary from an initial flow of from 5 to 30 ml/minute, to a final flow of from 20 to 60 ml/minute. The accelerated double jet profile can be linear, quadratic, or step-by-step, by employing silver and bromide salt solutions with different concentrations. Optionally, an iodide salt aqueous solution can be added during the growth.

4. To the resulting dispersion, an aqueous silver salt solution, an aqueous bromide salt solution, and, optionally, an aqueous iodide salt solution were added under stirring. The bromide and iodide salts can also be added from a single solution. The rate of addition can be kept constant in the range of from 5 to 60 ml/minute or can vary from an initial flow of from 5 to 30 ml/minute, to a final flow of from 20 to 60 ml/minute. The accelerated double jet profile can be linear, quadratic, or step-by-step, by employing silver and bromide salt solutions with different concentrations.

5. After the addition of an ammonia solution, an aqueous iodide salt solution was added at constant rate in a period of from one to five minutes.

6. After neutralizing the ammonia added during step 5, an aqueous silver salt solution, an aqueous bromide salt solution, and, optionally, an aqueous iodide salt solution were added under stirring. The bromide and iodide salts can also be added from a single solution. The rate of addition can be kept constant in the range of from 5 to 60 ml/minute or can vary from an initial flow of from 5 to 30 ml/minute, to a final flow of from 20 to 60 ml/minute. The accelerated double jet profile can be linear, quadratic, or step-by-step, by employing silver and bromide salt solutions with different concentrations.

The silver halide grain emulsion of the present invention can be chemically sensitized using sensitizing agents known in the art. Sulfur containing compounds, gold and noble metal compounds, and polyoxylakylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section 111, 1989.

The silver halide emulsion of the present invention can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pirazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The chemistry of Synthetic Dyes*, Academic Press, New York, 1971, Chapter V, James, *The Theory of the Photographic Process*, 4th Ed., Macmillan, 977, Chapter 8, F. M. Hamer, *Cyanine Dyes and Related Compounds*, John Wiley and Sons, 1964.

The silver halide emulsion of the present invention can be used for the manufacture of light-sensitive silver halide photographic elements, in particular color negative photographic elements, color reversal photographic elements, and the like.

Silver halide multilayer color photographic elements usually comprise, coated on a support, a red sensitized silver halide emulsion layer associated with cyan dye-forming color couplers, a green sensitized silver halide emulsion layer associated with magenta dye-forming color couplers and a blue sensitized silver halide emulsion layer associated with yellow dye-forming color couplers. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in any conventional order, but in a preferred layer arrangement the red-sensitive layers are coated nearest the support and are overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbon-amido, sulfonamido, ureido, ester, imido, carbamoyl, sulfamoyl bond, etc. Examples of suitable ballasting groups are described in U.S. Pat. No. 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally a acylacetanilide compound, is associated with blue-sensitive silver halide emulsion layers.

Said color couplers may be 4-equivalent and/or 2-equivalent couplers, the latter requiring a smaller amount of silver halide for color production. As is well known, 2-equivalent couplers derive from 4-equivalent couplers since, in the coupling position, they contain a substituent which is released during coupling reaction. 2-Equivalent couplers which may be used in silver halide color photographic elements include both those substantially colorless and those which are colored ("masked couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and α-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; and in British patent 1,201,110.

The most useful magenta-forming couplers are conventional pyrazolone type compounds, indazolone type compounds, cyanoacetyl compounds, pyrazoletriazole type compounds, etc, and particularly preferred couplers are pyrazolone type compounds. Magenta-forming couplers are described for example in U.S. Pat. Nos. 2,600,788, 2,983, 608, 3,062,653, 3,127,269, 3,311,476, 3,419,391, 3,519,429, 3,558,319, 3,582,322, 3,615,506, 3,834,908 and 3,891,445, in DE patent 1,810,464, in DE patent applications 2,408, 665, 2,417,945, 2,418,959 and 2,424,467 and in JP patent applications 20,826/76, 58,922/77, 129,538/74, 74,027/74, 159,336/75, 42,121/77, 74,028/74, 60,233/75, 26,541/76 and 55,122/78.

The most useful yellow-forming couplers are conventional open-chain ketomethylene type couplers. Particular examples of such couplers are benzoylacetanilide type and pivaloyl acetanilide type compounds. Yellow-forming couplers that can be used are specifically described in U.S. Pat. Nos. 2,875,057, 3,235,924, 3,265,506, 3,278,658, 3,369, 859, 3,408,194, 3,415,652 3,528,322, 3,551,151, 3,682,322, 3,725,072 and 3,891,445, in DE patents 2,219,917, 2,261, 361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650/75, 82,424/77 and 115,219/77.

Colored couplers can be used which include those described for example in U.S. Pat. Nos. 3,476,560, 2,521, 908 and 3,034,892, in JP patent publications 2,016/69, 22,335/63, 11,304/67 and 32,461/69, in JP patent applications 26,034/76 and 42,121/77 and in DE patent application 2,418,959. The light-sensitive silver halide color photographic element may contain high molecular weight color couplers as described for example in U.S. Pat. No. 4,080, 211, in EP Pat. Appl. No. 27,284 and in DE Pat. Appl. Nos. 1,297,417, 2,407,569, 3,148,125, 3,217,200, 3,320,079, 3,324,932, 3,331,743, and 3,340,376.

Colored cyan couplers can be selected from those described in U.S. Pat. Nos. 3,934,802; 3,386,301 and 2,434, 272, colored magenta couplers can be selected from the colored magenta couplers described in U.S. Pat. Nos. 2,434, 272; 3,476,564 and 3,476,560 and in British patent 1,464, 361. Colorless couplers can be selected from those described in British patents 861,138; 914,145 and 1,109,963 and in U.S. Pat. No. 3,580,722.

Also, couplers providing diffusible colored dyes can be used together with the above mentioned couplers for improving graininess and specific examples of these couplers are magenta couplers described in U.S. Pat. No. 4,366,237 and GB Pat. No. 2,125,570 and yellow, magenta and cyan couplers described in EP Pat. No. 96,873, and in DE Pat. Appl. No. 3,324,533.

Also, among the 2-equivalent couplers are those couplers which carry in the coupling position a group which is released in the color development reaction to give a certain photographic activity, e.g. as development inhibitor or accelerator or bleaching accelerator, either directly or after removal of one or further groups from the group originally released. Examples of such 2-equivalent couplers include the known DIR couplers as well as DAR, FAR and BAR couplers. Typical examples of said couplers are described in DE Pat. Appl. Nos. 2,703,145, 2,855,697, 3,105,026, 3,319, 428, 1,800,420, 2,015,867, 2,414,006, 2,842,063, 3,427,235, 3,209,110, and 1,547,640, in GB Pat. Nos. 953,454 and 1,591,641, and in EP Pat. Appl. Nos. 89,843, 117,511, 118,087, 193,389, and 301,477.

Examples of non-color forming DIR coupling compounds which can be used in silver halide color elements include those described in U.S. Pat. Nos. 3,938,996; 3,632,345; 3,639,417; 3,297,445 and 3,928,041; in German patent applications S.N. 2,405,442; 2,523,705; 2,460,202; 2,529, 350 and 2,448,063; in Japanese patent applications S.N. 143,538/75 and 147,716/75 and in British patents 1,423,588 and 1,542,705.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE patents 853,512 and 869,816, in U.S. Pat. Nos. 4,214,047 and 4,199,363 and in EP patent 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

The photographic elements, including a silver halide emulsion according to this invention, may be processed to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylendiamine derivatives, widely employed in various color photographic process. Particularly useful color developing agents are the p-phenylendiamine derivatives, especially the N,N-dialkyl-p-phenylene diamine derivatives wherein the alkyl groups or the aromatic nucleus can be substituted or not substituted.

Examples of p-phenilene diamine developers include the salts of: N,N-diethyl-p-phenylendiamine, 2-amino-5-diethylamino-toluene, 4-amino-N-ethyl-N-(α-methanesulphonamidoethyl)-m-toluidine, 4-amino-3-methyl-N-ethyl-N-(α-hydroxy-ethyl)-aniline, 4-amino-3-(α-methylsulfonamidoethyl)-N,N-diethylaniline, 4-amino-N, N-diethyl-3-(N'-methyl-α-methylsulfonamido)-aniline, N-ethyl-N-methoxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(β-hydroxyethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt on an alkali metal or of ammonium and of trivalent iron with an organic acid, e. g. EDTA.Fe.NH4, wherein EDTA is the ethylenediaminotetracetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath contains known fixing agents, such as for example ammonium or alkali metal thiosulfates. Both bleaching and fixing baths can contain other additives, e. g. polyalkyleneoxide derivatives, as described in GB patent 933,008 in order to increase the effectiveness of the bath, or thioethers known as bleach accelerators.

The present invention will be illustrated with reference to the following examples, but it should be understood that these examples do not limit the present invention.

EXAMPLE 1

Preparation of Silver Bromoiodide Emulsion 1 (invention)

A core-shell silver bromoiodide emulsion having a grain size of 1.5 μm was prepared according to the following procedure.

An aqueous solution prepared by dissolving 63.4 g of deionized gelatin, 18.9 g of potassium bromide, and 1.57 g of sodium thiocyanate in 2722 g of distilled water was stirred by a dispersator at 3500 rpm and T=57° C.

A double jet addition of 37.4 ml of a silver nitrate solution (2.5M) and 94.6 ml of a potassium bromide solution (3.2M) was performed at constant flow rate in two minutes. The emulsion was kept under stirring for 30 seconds.

After that, 680 ml of a silver nitrate solution (2.5M) were added with a linear accelerated ramp (from 20 ml/min to 48 ml/min) and at the same time a potassium bromide solution (3.2M) was added to change the pAg value (measured with a $Ag_2S$/Calomel Electrode) from −83 mV to −63 mV. The double-jet addition was completed in twenty minutes.

During the next five minutes, a silver nitrate solution (2.5M) was added at constant flow rate (48 ml/min) and a potassium iodide solution (0.5M) was added at constant flow rate of 11.1 ml/min by maintaining the pAg value at −63 mV with a potassium bromide solution (3.2M).

During the next fourteen minutes, a silver nitrate solution (2.5M) was added with a linear reversed ramp (from 48 ml/min to 10 ml/min). At the same time a KBr solution (3.2M) was added in order to change the pAg from −63 to +50 mV.

After one minute pause, 103.0 ml of an ammonia solution (12N) were added, followed by the addition of 214.2 ml of a potassium iodide solution (0.5M) in three minutes.

During the next twentyfive minutes, 452.5 ml of a silver nitrate solution (2.5M) and 380 ml of a potassium iodide solution (0.5M) were added at constant flow rate, by maintaining the pAg value at −10 mV with a potassium bromide solution (3.2M). The pH was then reduced at 6.0 neutralizing the ammonia present in the system with a sulfuric acid solution (25%).

Finally, 543 ml of a silver nitrate solution (2.5M) were added with constant flow rate in 30 minutes by mantaining the pAg value at −10 mV with a potassium bromide solution (3.2M).

EXAMPLE 2

Preparation of Silver Bromoiodide Emulsion 2 (comparison)

A core-shell silver bromoiodide emulsion having a grain size of 1.5 μm was prepared according to the following procedure.

An aqueous solution prepared by dissolving 63.4 g of deionized gelatin, 18.9 g of potassium bromide, and 1.57 g of sodium thiocyanate in 2722 g of distilled water was stirred by a dispersator at 3500 rpm and T=57° C.

A double jet addition of 37.4 ml of a silver nitrate solution (2.5M) and 94.6 ml of a potassium bromide solution (3.2M) was performed at constant flow rate in two minutes. The emulsion was kept under stirring for 30 seconds.

After that, 680 ml of a silver nitrate solution (2.5M) were added with a linear accelerated ramp (from 20 ml/min to 48 ml/min) and at the same time a potassium bromide solution (3.2M) was added to change the pAg value (measure with a $Ag_2S$/Calomel Electrode) from −83 mV to −63 mV. The double-jet addition was completed in twenty minutes.

During the next fourteen minutes, a silver nitrate solution (2.5M) was added with a linear reversed ramp (from 48 ml/min to 10 mlmin). At the same time a KBr solution (3.2M) was added in order to change the pAg from −63 to +50 mV.

During the next twentyfive minutes, 452.5 ml of a silver nitrate solution (2.5M) and 380 ml of a potassium iodide solution (0.5M) were added at constant flow rate, by maintaining the pAg value at −10 mV with a potassium bromide solution (3.2M).

Then, 539.4 ml of a silver nitrate solution (2.5M) and 269.7 ml of a silver iodide solution (0.5M) were added with constant flow rate in 30 minutes by mantaining the pAg value at −10 mV with a potassium bromide solution (3.2M).

Finally, 244.4 ml of a silver nitrate solution (2.5M) were added with constant flow rate in 13.5 minutes by mantaining the pAg value at −10 mV with a potassium bromide solution (3.2M).

EXAMPLE 3

Preparation of Silver Bromoiodide Emulsion 3 (comparison)

A core-shell silver bromoiodide emulsion having a grain size of 1.5 μm was prepared according to the following procedure.

An aqueous solution prepared by dissolving 63.4 g of deionized gelatin, 18.9 g of potassium bromide, and 1.57 g of sodium thiocyanate in 2722 g of distilled water was stirred by a dispersator at 3500 rpm and T=57° C.

A double jet addition of 37.4 ml of a silver nitrate solution (2.5M) and 94.6 ml of a potassium bromide solution (3.2M) was performed at constant flow rate in two minutes. The emulsion was kept under stirring for 30 seconds.

After that, 680 ml of a silver nitrate solution (2.5M) were added with a linear accelerated ramp (from 20 ml/min to 48 ml/min) and at the same time a potassium bromide solution (3.2M) was added to change the pAg value (measured with a $Ag_2S$/Calomel Electrode) from −83 mV to −63 mV. The double-jet addition was completed in twenty minutes.

During the next five minutes, a silver nitrate solution (2.5M) was added at constant flow rate (48 ml/min) by maintaining the pAg value at −63 mV with a potassium bromide solution (3.2M).

During the next fourteen minutes, a silver nitrate solution (2.5M) was added with a linear reversed ramp (from 48 ml/min to 10 ml/min). At the same time a KBr solution (3.2M) was added in order to change the pAg from −63 to +50 mV.

After one minute pause, 238.8 ml of a potassium iodide solution (0.5M) were added in three minutes at constant flow rate.

518.9 ml of a silver nitrate solution (2.5M) and 435.5 ml of a potassium iodide solution (0.5M) were added in 28 minutes and 40 seconds at constant flow rate, by maintaining the pAg value at −10 mV with a potassium bromide solution (3.2M).

Finally, 476.6 ml of a silver nitrate solution (2.5M) were added with constant flow rate in 26 minutes and 20 seconds by mantaining the pAg value at −10 mV with a potassium bromide solution (3.2M).

EXAMPLE 4

Preparation of Silver Bromoiodide Emulsion 4 (invention)

A core-shell silver bromoiodide emulsion having a grain size of 1.1 μm was prepared according to the following procedure. An aqueous solution prepared by dissolving 63.4 g of deionized gelatin, 18.9 g of potassium bromide, and 1.57 g of sodium thiocyanate in 2722 g of distilled water was stirred by a dispersator at 3500 rpm and T=57° C.

A double jet addition of 37.4 ml of a silver nitrate solution (2.5M) and 94.6 ml of a potassium bromide solution (3.2M) was performed at constant flow rate in two minutes. The emulsion was kept under stirring for 30 seconds.

After that, 680 ml of a silver nitrate solution (2.5M) were added with a linear accelerated ramp (from 20 ml/min to 48 ml/min) and at the same time a potassium bromide solution (3.2M) was added to change the pAg value (measure with a $Ag_2S$/Calomel Electrode) from −83 mV to −63 mV. The double-jet addition was completed in twenty minutes.

During the next ten minutes, a silver nitrate solution (2.5M) was added with a linear reversed ramp (from 40 ml/min to 8 ml/min). At the same time a KBr solution (3.2M) was added in order to change the pAg from −63 to +50 mV.

After one minute pause 103 ml of ammonia solution (12M) were added.

Then, 518.9 ml of a silver nitrate solution (2.5M) and 435.5 ml of a potassium iodide solution (0.5M) were added in 28 minutes at constant flow rate, by maintaining the pAg value at −10 mV with a potassium bromide solution (3.2M).

After one minute pause, 214.7 ml of a potassium iodide solution (0.5M) were added in three minutes at constant flow rate.

Then, the pH was reduced at 6.0, neutralizing the ammonia present in the system with a sulfuric acid solution (25%).

Finally, 884.0 ml of a silver nitrate solution (2.5M) were added with constant flow rate in 40 minutes by mantaining the pAg value at −10 mV with a potassium bromide solution (3.2M)

The following table 1 summarizes the core-shell structure of emulsions 1 to 4.

TABLE 1

| | Emulsion 1* | | Emulsion 2 | | Emulsion 3** | | Emulsion 4*** | |
|---|---|---|---|---|---|---|---|---|
| | % Ag | AgI % | % Ag | AgI % | % Ag | AgI % | % Ag | AgI % |
| Core | 30.4 | 0.0 | 47.6 | 0.0 | 56.0 | 0.0 | 40.6 | 0.0 |
| I Shell | 10.2 | 4.6 | 19.2 | 16.8 | 22.0 | 16.8 | 20.2 | 16.8 |
| II Shell | 15.4 | 0.0 | 22.8 | 10.0 | 20.2 | 0.0 | 37.4 | 0.0 |
| III Shell | 19.2 | 16.8 | 10.4 | 0.0 | — | — | — | — |
| IV Shell | 23.0 | 0.0 | — | — | — | — | — | — |

*Emulsion 1 has a pure iodide phase representing 1.8% of the total Ag between shells II and III
**Emulsion 3 has a pure iodide phase representing 1.8% of the total Ag between core and shell I
***Emulsion 4 has a pure iodide phase representing 1.8% of the total Ag between shell I and shell II All the emulsions were optimally chemically digested with gold and sulfur using p-toluenethiosulfonic acid p-toluenesulfinic acid and gold tetrachloroaurate complexed with potassium thiocyanate.

A magenta monochrome film was obtained from each emulsion 1 to 4 by using green sensitizing dyes S-4 and S-5, magenta coupler M-1 and conventional coating formulation. The silver coverage of the magenta layer was 1.50 g $Ag/m^2$. Samples of each film were exposed to a white light source having a color temperature of 5,500 Kelvin. All the exposed samples were developed in a standard type C41 process as described in British Journal of Photography, Jul. 12, 1974, pp. 597–598. The sensitometric results are showed in the following Table 2. The graininess was visually evaluated on the developed samples by means of scholastic scores ranging from 5 to 10.

TABLE 2

| | Dmin | Dmax | Speed 0.2 | Speed 1.0 | Graininess |
|---|---|---|---|---|---|
| Emulsion 1 (Invention) | 0.17 | 3.19 | 2.78 | 2.30 | 9 |
| Emulsion 2 (Comparison) | 0.17 | 3.03 | 2.71 | 2.20 | 7 |
| Emulsion 3 (Comparison) | 0.17 | 3.35 | 2.38 | 1.76 | 10 |
| Emulsion 4 (Invention) | 0.18 | 2.80 | 2.70 | 2.15 | 9.5 |

The data of Table 2 clearly show the superior overall characteristics of the silver halide emulsions of the present invention. By comparing emulsion 1 of the invention with comparison emulsions 2 and 3 having the same grain size, the results show the best compromise in terms of sensitometric characteristics (Dmin, Dmax, and speed) and graininess. Comparison emulsion 2 in spite of having similar sensitometric results shows an unacceptable grainininess. Comparison emulsion 3 in spite of having an excellent graininess has unacceptable sensitometric characteristics. Emulsion 4 of the invention (which has a lower grain size) still shows sensitometric results comparable to those of comparison emulsion 2 with an excellent grain size.

Formulas of compounds used in the present invention will be presented below.

Green Sensitizer S-4

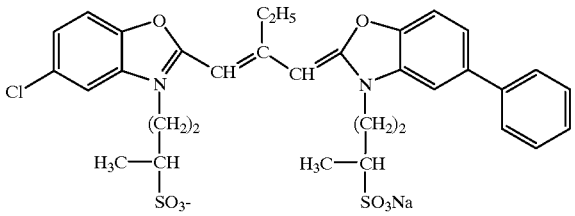

Green Sensitizer S-5

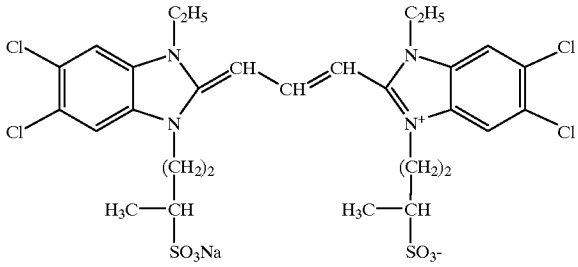

Magenta Coupler M-1

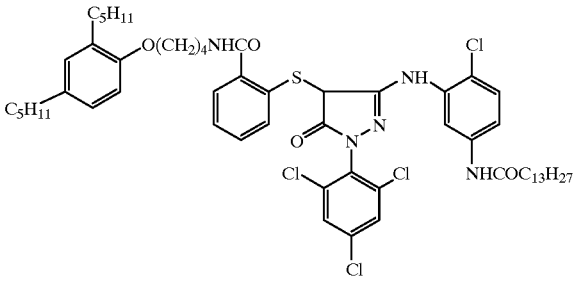

What is claimed is:

1. A light-sensitive emulsion comprising silver bromoiodide grains of a core shell structure comprising:

a) an inner core consisting essentially of silver bromide or silver bromoiodide, the silver iodide content of said inner core being within the range of 0 to 20 mole %, and b) an odd plurality of three or five shells consisting essentially of silver bromide or silver bromoiodide, wherein a pure silver iodide phase representing from 0.1 to 5 mole % of the total silver halide grain content is interposed between two adjacent shells, and wherein at least one of said adjacent shells has a silver iodide content higher than 10 mole %.

2. The light-sensitive emulsion according to claim 1, wherein said inner core consists essentially of silver bromide.

3. The light-sensitive emulsion according to claim 1, wherein said silver bromoiodide grains have an average iodide content ranging from 1 to 10 mol %, relative to the total halide content of the grains.

4. The light-sensitive emulsion according to claim 1, wherein the silver content of said inner core ranges from 20 to 70 mol % relative to the total silver content of the grain and the silver content of each shell of said plurality of shells ranges from 5 to 40 mol % relative to the total silver content of the grain.

5. The light-sensitive emulsion according to claim 1, wherein said plurality of shells comprises at least:

a) an inner shell consisting essentially of silver bromide or silver bromoiodide, the silver iodide content of said inner shell being within the range of from 0 to 40 mole %, b) a pure silver iodide phase on the inner shell representing from 0.1 to 5 mole % of the total silver halide grain content, and b) an outer shell on the pure silver iodide phase consisting essentially of silver bromide or silver bromoiodide, the silver iodide content of said outer shell being within the range of from 0 to 40 mole % wherein at least one of said inner or outer shells has a silver iodide content higher than 5 mole %.

6. The light-sensitive emulsion according to claim 5, wherein said plurality of shells further comprises a first innermost shell on the core, said innermost shell consisting essentially of silver bromoiodide with a silver iodide content within the range of from 2 to 20 mole % and an outermost shell consisting essentially of silver bromide.

7. A light-sensitive silver halide photographic material comprising a support and at least on silver halide emulsion layer which comprises silver bromoiodide grains of a core shell structure comprising:

a) an inner core consisting essentially of silver bromide or silver bromoiodide, the silver iodide content of said inner core being within the range of 0 to 20 mole %, and b) an odd plurality of three or five shells consisting essentially of silver bromide or silver bromoiodide, wherein a pure silver iodide phase representing from 0.1 to 5 mole % of the total silver halide grain content is interposed between two adjacent shells, and wherein at least one of said adjacent shells has a silver iodide content higher than 10 mole %.

8. The light-sensitive silver halide photographic material according to claim 7, wherein said inner core consists essentially of silver bromide.

9. The light-sensitive silver halide photographic material according to claim 7, wherein said silver bromoiodide grains have an average iodide content ranging from 1 to 15 mol %, relative to the total halide content of the grains.

10. The light-sensitive silver halide photographic material according to claim 7, wherein the silver content of said inner core ranges from 20 to 70 mol % relative to the total silver content of the grain and the silver content of each shell of said plurality of shells ranges from 5 to 40 mol % relative to the total silver content of the grain.

11. A light-sensitive emulsion comprising silver bromoiodide grains of a core shell structure comprising:

a) an inner core consisting essentially of silver bromide or silver bromoiodide, the silver iodide content of said inner core being within the range of 0 to 20 mole %, and b) a plurality of an odd number of shells consisting essentially of silver bromide or silver bromoiodide, wherein a pure silver iodide phase representing from 0.1 to 5 mole % of the total silver halide grain content is interposed between two adjacent shells, and wherein at least one of said adjacent shells has a silver iodide content higher than 10 mole %.

12. A light-sensitive silver halide photographic material comprising a support and at least on silver halide emulsion layer which comprises silver bromoiodide grains of a core shell structure comprising:

a) an inner core consisting essentially of silver bromide or silver bromoiodide, the silver iodide content of said inner core being within the range of 0 to 20 mole %, and b) a plurality of an odd number of shells consisting essentially of silver bromide or silver bromoiodide, wherein a pure silver iodide phase representing from 0.1 to 5 mole % of the total silver halide grain content is interposed between two adjacent shells, and wherein at least one of said adjacent shells has a silver iodide content higher than 10 mole %.

* * * * *